United States Patent [19]

Takeda et al.

[11] Patent Number: 4,651,149

[45] Date of Patent: Mar. 17, 1987

[54] LIQUID CRYSTAL DISPLAY DRIVE WITH REDUCED POWER CONSUMPTION

[75] Inventors: Makoto Takeda, Tenri; Kunihiko Yamamoto, Nara; Hiroshi Take, Ikoma, all of Japan

[73] Assignee: Sharp Kabushiki Kaisha, Osaka, Japan

[21] Appl. No.: 648,285

[22] Filed: Sep. 7, 1984

[30] Foreign Application Priority Data

Sep. 12, 1983 [JP] Japan ..... 58-170360

[51] Int. Cl.[4] ..... G09G 3/36

[52] U.S. Cl. ..... 340/805; 340/811; 340/784

[58] Field of Search ..... 340/718, 719, 784, 802, 340/805, 811, 783

[56] References Cited

U.S. PATENT DOCUMENTS

| | | | |
|---|---|---|---|
| 4,099,073 | 7/1978 | Hashimoto et al. | 340/805 |
| 4,395,708 | 7/1983 | Lloyd | 340/784 |
| 4,471,347 | 9/1984 | Nakazawa et al. | 340/811 |
| 4,529,890 | 7/1985 | Kobayashi et al. | 340/805 |
| 4,532,506 | 7/1985 | Kitazina et al. | 340/784 |

*Primary Examiner*—Gerald L. Brigance

*Attorney, Agent, or Firm*—Birch, Stewart, Kolasch and Birch

[57] ABSTRACT

An active matrix liquid crystal display is provided with one switching transistor connected to each display element. A separate drive circuit is connected to each column of the matrix, each such drive circuit incorporating a buffer circuit which is constructed of an output transistor and three separate switching elements. The buffer circuit transfers a sample of a data input signals to the respective column while requiring reduced power over conventional drivers.

2 Claims, 8 Drawing Figures

FIG. 2(a)
CONVENTIONAL ART
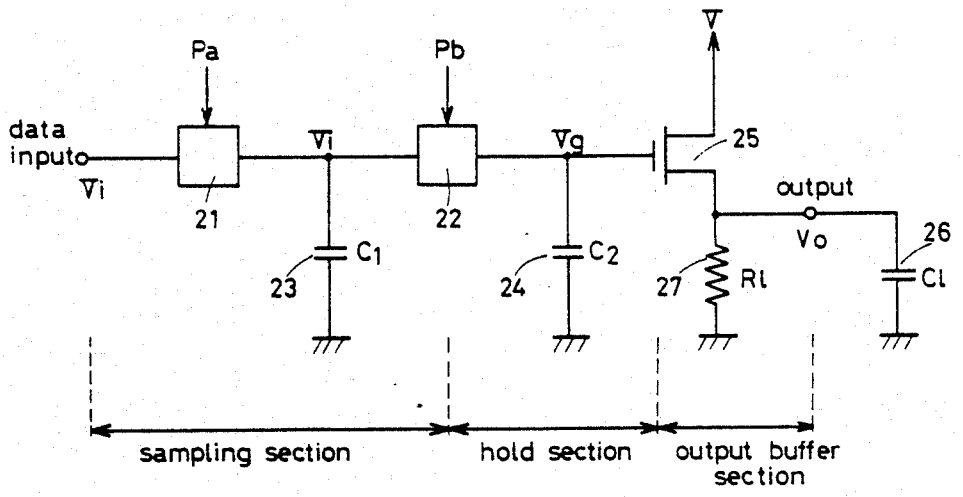
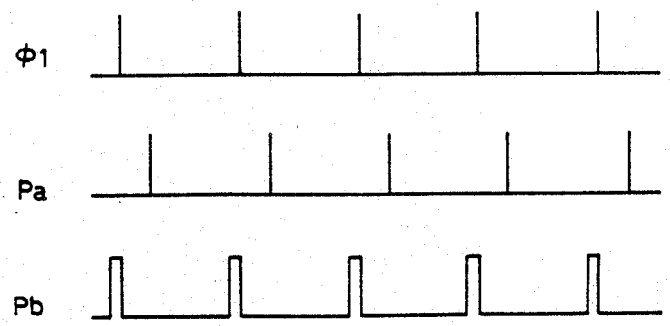
FIG. 2(b)
CONVENTIONAL ART

LIQUID CRYSTAL DISPLAY DRIVE WITH REDUCED POWER CONSUMPTION

BACKGROUND OF THE INVENTION

The present invention relates to a matrix liquid crystal display device, more particularly, to the drive circuit of a matrix liquid crystal display device provided with switching transistors connected to each picture element of the matrix display pattern.

Conventionally, it is well known that, even when a small-duty drive or multi-line multiplex drive is performed, a high-contrast display equivalent to a static-drive display can be achieved in such a matrix liquid crystal display device using switching transistors built in the LCD panel. Typically, such a liquid crystal display device has a circuit configuration and signal waveforms shown in FIG. 1. In FIG. 1, reference number 11 indicates the LCD panel, and a switching transistor 11-*c* is connected to the crossing of row electrode 11-*a* and column electrode 11-*b*. Reference number 12 indicates a row electrode driver mainly composed of a shift register, which outputs scan pulse S to each row electrode by sequentially shifting this pulse by using clock pulse $\phi 1$ delivered from the signal controller 13. Reference 14 indicates a column electrode driver mainly composed of a shift register and a sample holder, which samples data sent in series from a data controller 15 with such a timing that corresponds with each column electrode synchronous with clock pulse $\phi 2$, and then holds a sample value for one scan period (F) before eventually sending it to respective column electrodes.

Of a plurality of the data signal voltages dealing with respective picture elements and arriving in series, the column electrode driver 14 in the drive circuit actually samples only such a voltage which is exactly in the period dealing with picture elements of the corresponding column, and then simultaneously delivers the sampled voltage to all of the column electrodes during the next one-scan period. A typical example of this drive circuit is shown in FIG. 2. Reference numbers 21 and 22 respectively indicate electric switches which turn ON themselves when control signals Pa and Pb are received. When the electric switch 21 momentarily turns ON upon receipt of the control signal Pa dealing with the corresponding column, the data voltage at this moment is charged into capacitor 23. After completing samplings from all columns, the control signal Pb turns switch 22 ON immediately before the sampling from the first column is resumed, causing capacitor 23 to discharge its stored voltage to capacitor 24, and then this voltage is held during the next scan period. While this voltage still remains in capacitor 24, the next data voltage is sampled by capacitor 23. The sampled voltage held by capacitor 24 is then delivered as a load to the column electrode 26 via the output buffer circuit. It may be determined that the load corresponds to a capacitor that synthesizes both the liquid crystal capacitance and free capacitance of the switching transistors.

In this drive circuit, resistor 27 connected in series to load 26 discharges the charge stored in load 26. Transistor 25 of the output buffer is prepared to allow current to constantly flow in one direction, and therefore, if resistor 27 is absent, load 26 always charges itself without following any variation of input signals that require discharge. As a result, time constants CL and RL should be set at such values significantly less than the one-scan period. However, since current constantly flows through resistor 27, if there are many drive lines and large load, current consumption becomes a problem. Likewise, capacitance C1 should be set in this drive circuit at a value significantly greater than C2 to properly deliver the sampled voltage from capacitor 23 to capacitor 24. The reason for this is described below. If capacitances C1 and C2 were set at values close to each other, as shown by the equation $Vg=(C1Vi+C2Vg')/(C1+C2)$ (where Vg' indicates the voltage charged in C2), the voltage Vg to be delivered from capacitor 23 to capacitor 24 can be varied by the voltage Vg' in capacitor 24 before the capacitance values of C1 and C2 and their voltages are delivered to capacitor 24, and as a result, the display of a certain row may be adversely affected by the display content of the preceding rows, making it difficult to delicately display interim tones. Nevertheless, from the viewpoint of current consumption and the needs for high-density part integration, it is not desirable to excessively expand the capacitance, since it will easily cause the display quality to degrade itself.

OBJECT AND SUMMARY OF THE INVENTION

In the light of those problems existing in the conventional drive circuits of a matrix liquid crystal display device, the present invention aims at providing a unique and useful drive circuit for matrix liquid crystal display devices featuring minimum current consumption and achieving a still higher density part integration as well.

The present invention relates to a drive circuit of a matrix liquid crystal display device provided with switching transistors for each display picture element. The drive circuit according to the preferred embodiment of the present invention contains a circuit that allows the row electrode driver to sample the voltage of the incoming data signal, where the row electrode driver feeds such voltages, producing heavy and light display tones to respective row electrodes connected to the terminals of the switching transistors; a first electric switch that delivers the sampled data voltage to the following output transistor gate and holds it during such a period when no sampling is performed; a second electric switch that compulsorily causes the charge in the output terminal of the above output transistor to be discharged until a specific voltage level is reached within a short period immediately before the first electric switch turns ON; and a third electric switch that delivers a voltage that turns the above output transistor OFF to the transistor's gate at least during such a period while the second electric switch remains ON. Preferably, the drive circuit should be designed so that the dischargeable amount of the voltage can be minimized when discharging the charge from the output terminal of the output transistor through the second electric switch.

Briefly speaking, the drive circuit according to the preferred embodiment of the present invention functions so as to minimize the current consumption by restraining the charge in the load to be discharged only by a minimum amount for a short duration of time, by effectively substituting electric switches in place of a discharge resistor which is in the output buffer of the column electrode driver.

BRIEF DESCRIPTION OF THE DRAWINGS

FIGS. 2(*a*) and 2(*b*), respectively, show an example of the conventional column electrode drive circuit and waveforms generated by the conventional circuit.

DETAILED DESCRIPTION OF PREFERRED EMBODIMENT

Figure 1A:
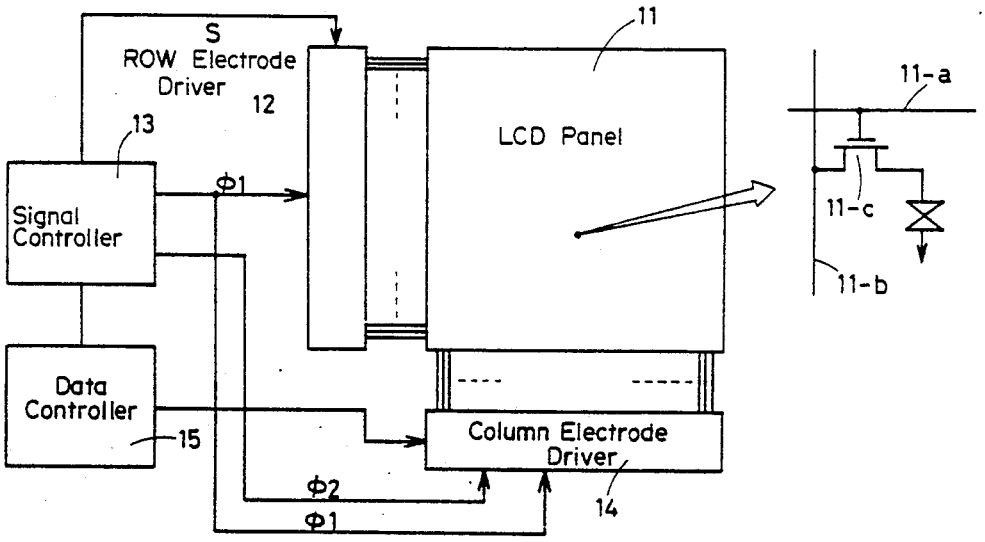
FIG.1(a) CONVENTIONAL ART
FIGS. 1(*a*) and 1(*b*), respectively, show a simplified block diagram of a liquid crystal display device provided with switching transistors and waveforms generated during driving of the device.
Figure 1:
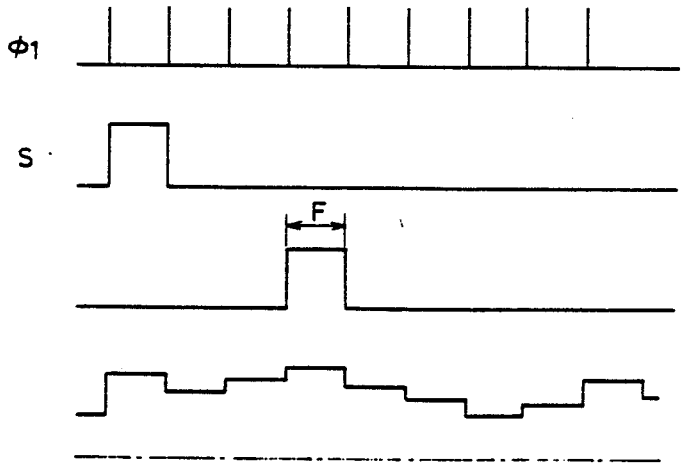
FIG.1 (b) CONVENTIONAL ART
Figure 3A:
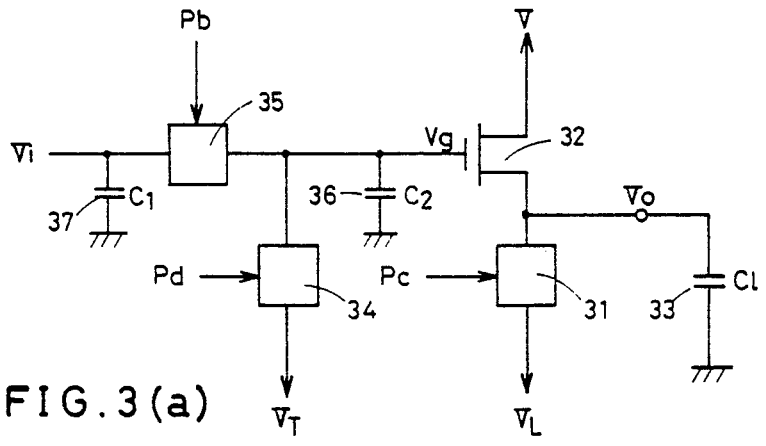
FIGS. 3(*a*) and (*b*) and 4(*a*) and (*b*) respectively show a drive circuit diagram and waveforms generated therefrom according to a first and a second preferred embodiment of the present invention.
Figure 3B:
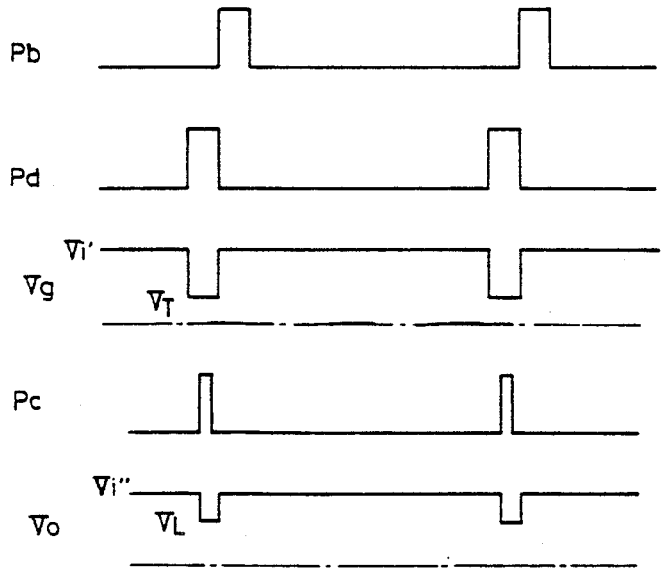

FIG. 3 shows a drive circuit configuration reflecting a preferred embodiment of the present invention. The electric switch 31 connected to the output of the gate-insulated transistor is in parallel with load 33. It has the function of compulsorily setting the output terminal of transistor 32 at the VL potential by operating the control signal Pc so that the charge can be discharged from load 33. In addition, the electric switch 34 is connected to the gate electrode of transistor 32. While the charge is discharged from load 33 via the electric switch 31, the electric switch 34 feeds a large enough amount of the voltage VT to the gate electrode so that transistor 32 is turned OFF at least during such a period while the electric switch 31 is ON. Therefore, no charge can be delivered to load 33 via transistor 32. The gate electrode of transistor 32 is also connected to the electric switch 35 that delivers the sampled data voltage Vi to the output buffer for holding.

Principles of the circuit operations are described below. First, when the gate voltage of the output buffer is set at the VT level, before feeding the data voltage Vi to the output buffer 32 via the electric switch 35, the electric switch 34 turns ON and transistor 32 is OFF, and then the electric switch 31 turns ON to allow the charge to be discharged from load 33 so that the voltage at the output terminal can be lowered to a specific level VL. Then, the electric switch 34 turns OFF and the electric switch 35 turns ON to allow the data voltage to enter the output buffer, turning transistor 32 ON, and then, load 33 is recharged to allow the data voltage to go out. Voltage waveforms from respective points during this period are shown in FIG. 3(*b*). The drive circuit reflecting the preferred embodiment of the present invention causes charge in load 33 to be discharged via switches, thus eliminating a constant flow of current through a discharge resistor and solving problems that have thus far existed in all conventional drive circuits. As a result, this drive circuit effectively minimizes the current consumption in the column electrode driver. In addition, since this drive circuit can cause the discharge voltage VL from the output terminal to vary in response to any data voltage expected during a specific period, it makes it possible to minimize the amount of charge to be applied to and discharged from load 33, thus eventually resulting in further savings of power consumption.

Figure 4A:
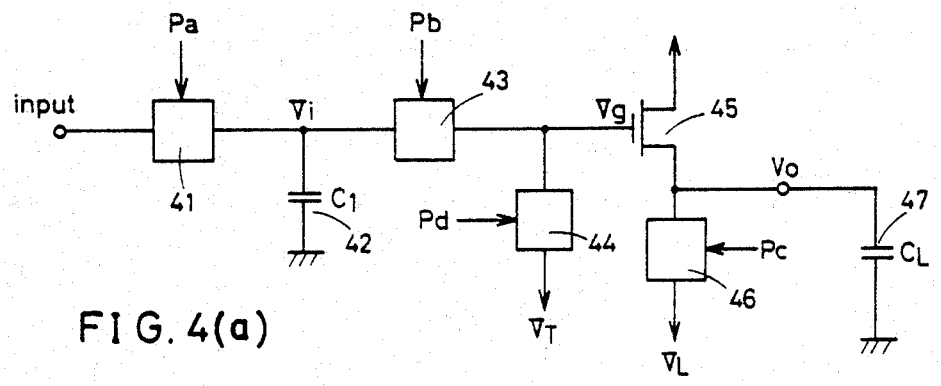
Figure 4B:
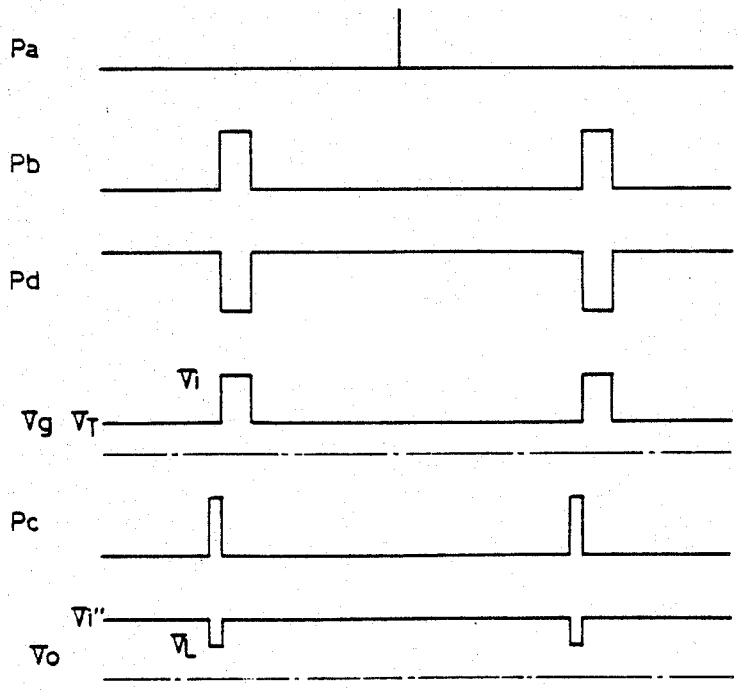

The drive circuit according to the preferred embodiment of the present invention causes the charge voltage in capacitor 36 to constantly remain in a specific value VT via the electric switch 34 immediately before feeding the data voltage to the output transistor 32 via the electric switch 35. Even if the capacitance C1 is not greater than C2, since the lowered amount of the transferrable voltage is determined by C1 and C2 as described earlier, display of any row is not adversely affected by the display content of the preceding row. This creates a clear display. In addition, the output buffer of this drive circuit applies the voltage Vg to the gate of the output transistor 32 so that this transistor turns ON to charge load 33 and and a specific voltage corresponding to Vg can be output. When load 33 is charged to the saturation value, the output transistor turns OFF itself and remains OFF unless the voltage Vg rises. In other words, these operations provide the same effect as if the output buffer itself were provided with the holding fuction in this circuit, thus making it possible to delete the holder capacitor 36. If the holder capacitor is absent, the size of capacitor 37 can be reduced, thus offering a great convenience for implementing a high-density part integration. After sufficiently charging load 33 and before the electric switch 31 again turns ON, the electric switch 34 keeps the output transistor completely OFF, ensuring a stable output. Actual conditions of the drive circuit and waveforms during these operations are shown in FIGS. 4(*a*) and (*b*). In FIG. 4, reference numbers 41, 43, 44, and 46 respectively indicate the electric switches, whereas 42 indicates the sampling capacitor and 45 the output transistor.

As is clear from the foregoing description, the liquid crystal display drive circuit embodied by the present invention effectively minimizes power consumption and provides a great convenience for achieving high-density part integration. In particular, this drive circuit is extremely useful for driving a large-capacity matrix liquid crystal display device.

What is claimed is:

1. A driving circuit for each of a plurality of column electrodes in a liquid crystal display device that is provided with a plurality of switching transistors, each switching transistor connected to one display picture element, comprising:

sampling means for detecting a sample of an input data signal;

buffer means for transferring said sample of said input data signal to the column electrode after holding said sample for a predetermined time, said buffer means including, an output transistor having a gate electrode and first and second active electrodes, said first active electrode being connected to the column electrode, first switching means, connected to said gate electrode, for selectively supplying a turn-off voltage to said output transistor, and second switching means, connected to said first active electrode, for selectively discharging the column electrode to a predetermined voltage level; and third switching means, connected between said sampling means and said buffer means for selectively applying said sample of an input data signal to said buffer means, said second switching means discharging the column electrode when said first switching means supplies said turn-off voltage to said output transistor, said third switching means applying said sample to said buffer means only when said first switching means is not supplying said turn-off voltage to said output transistor.

2. The driving circuit of claim 1 wherein said first switching means is responsive to a charge load at the first active electrode of said output transistor such that said first switching means supplies said turn-off voltage to said output transistor when said charge load is at a saturation value.

* * * * *